US005544589A

United States Patent [19]

Held

[11] Patent Number: 5,544,589

[45] Date of Patent: Aug. 13, 1996

[54] FRAGMENTATION WARHEAD

[75] Inventor: Manfred Held, Aresing, Germany

[73] Assignee: Daimler-Benz Aerospace AG, Munich, Germany

[21] Appl. No.: 990,117

[22] Filed: Dec. 2, 1992

[30] Foreign Application Priority Data

Sep. 6, 1991 [DE] Germany ..... 41 39 372.4

[51] Int. Cl.[6] ..... F42B 12/22

[52] U.S. Cl. ..... 102/492; 102/475; 102/495

[58] Field of Search ..... 102/473, 475, 102/476, 491, 492, 494–497, 305, 493

[56] References Cited

U.S. PATENT DOCUMENTS 3,714,897 2/1973 Parker ..... 102/475
3,977,330 8/1976 Held ..... 102/476
4,160,415 7/1979 Cole ..... 102/476
5,050,503 9/1991 Menz et al. ..... 102/475

FOREIGN PATENT DOCUMENTS 2388468 12/1978 France ..... 102/473

*Primary Examiner*—Harold J. Tudor
*Attorney, Agent, or Firm*—McGlew and Tuttle, P.C.

[57] ABSTRACT

An axially extending fragmentation warhead having a plurality of separate axially extending deformation charges in its radially outer surface. The deformation charges are located in a damping layer enclosing a fragmentation layer covering a cylindrical jacket enclosing a main explosive charge. The deformation charges facing a target can be individually ignited to inwardly deform the cylindrical jacket and the fragmentation layer prior to igniting the main explosive charge for selectively directing the fragmentation layer at the target. The deformation charges can be ignited individually or in selected groups to increase the effectiveness of the fragments directed at the target.

5 Claims, 3 Drawing Sheets

FRAGMENTATION WARHEAD

The present invention is directed to a fragmentation warhead including an axially extending cylindrical jacket with an outer surface and an inner surface. A fragmentation layer encircles and is in contact with the outer surface of the jacket. A plurality of separate deformation charges are located around and spaced outwardly from the fragmentation layer, with the deformation charges extending in the axial direction of the jacket and arranged to indent the jacket and fragmentation layer along a side of the warhead facing a target before igniting a main explosive charge located within the jacket.

Such warhead types are known. The jacket is indented or crushed inwardly before the fragments are formed by igniting the deformation charge facing the target so that a greater hit density is achieved than in conventional fragmentation warheads containing a rigid fragmentation jacket. In such a fragmentation warhead the fragments formed at the indented or deformed point of the jacket are projected towards the target along a parallel path if the indented section is planar. As a result, the fragments do not fly radially apart as in conventional fragmentation warheads with rigid jackets.

The effectiveness of such detonation deformable fragmentation warheads leaves something to be desired.

SUMMARY OF THE INVENTION

Therefore, it is the primary object of the present invention to increase the effectiveness of detonation deformable fragmentation warheads.

In accordance with the present invention, the detonation charges are controlled individually and several deformation charges can be ignited at the same time.

In place of large deformation charges, it is possible in the present invention to detonate several smaller deformation charges to indent or deform inwardly the jacket in the warhead on the side facing the target. As a result, the mass of the individual deformation charges can be designed relatively small, whereby the loading exerted upon the jacket per unit area is considerably reduced when such deformation charges are ignited. The smaller deformation charges result at the same time in a shorter shock wave loading so that the shock wave impulses per unit area of the jacket are noticeably reduced. Moreover, the detonation of several smaller deformation charges provides a homogenous loading of the jacket, even in the case of a relatively large width of the indented region. Accordingly, a relatively large sector of the jacket can be deformed inwardly in a planar form.

Furthermore, the indented or deformed region in the invention can be very accurately aligned towards the target, whereby the angular extent of the deformed sector of the jacket as compared to the target is as large as the angle between the individual deformation charges. With at least twelve deformation charges arranged around a jacket in the warhead, the angular extent between charges is 30° (360/12) and with a larger quantity of deformation charges this angle can be even smaller.

In accordance with the present invention, the sector to be deformed inwardly can be adjusted in a very accurate manner. As a result, one, two, three or more deformation charges are ignited based on the desired angular size of the sector and the degree of focusing to be provided.

Further, the warhead of the present invention affords adjustment of the geometry of the deformed sector of the jacket. The deformation charges can be arranged in such a way that the jacket is deformed in a planar shape, if only every second deformation charge at the side facing the target is ignited with the jacket being indented in a more pronounced manner with a concave shape, if all of the deformation charges on the side of the jacket are facing the target are fired. On the other hand, the jacket can be deformed in a slightly convex manner if, for instance, only every third deformation charge on the side facing the target is ignited. As a result, the flight direction of the fragments is correspondingly different. Accordingly, if the fragments are projected outwardly in an essentially parallel manner towards the target where the deformed sector is in a planar form, they are focused on a line or a point spaced from the warhead in the case of a concave deformation of the jacket, while if the deformed sector is convex, the fragments diverge in a more or less pronounced manner. Another adjustment of the deformation of the jacket can be achieved if the deformation charges on the side facing the target are not fired simultaneously, but rather are ignited with a specific time delay. As a result, the fragmentation warhead of the present invention can be accurately matched to the interception geometry meaning distance, angular position of the warhead with respect to the target and the target size. If the warhead is at a greater distance from the target, it is more strongly focused than in proximity to the target. The firing logic is afforded where the deformation charges are controlled as a function of the target type determined by the sensor of the warhead.

DETAILED DESCRIPTION OF THE INVENTION

Figure 1:
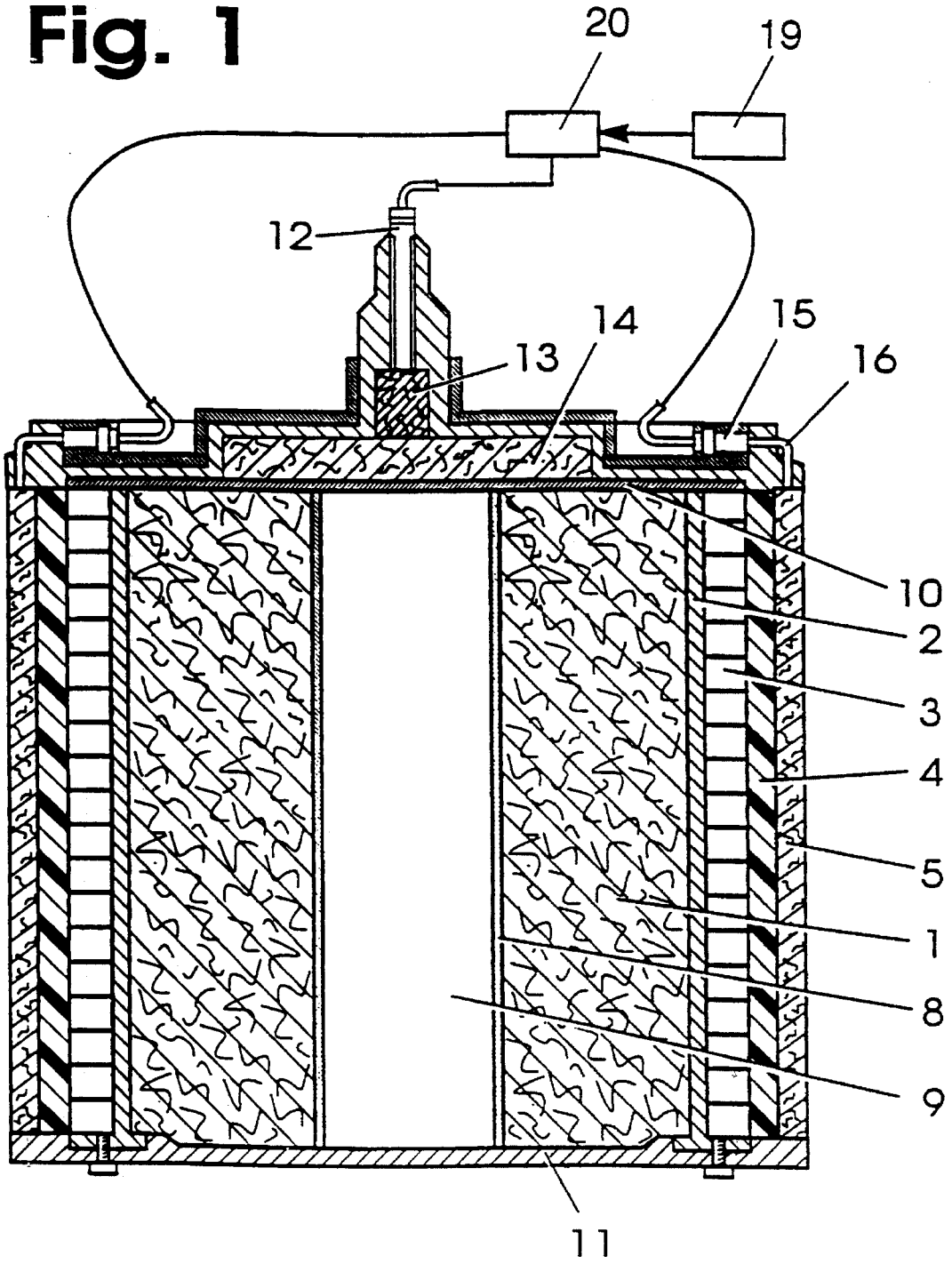
FIG. 1 is an axially extending sectional view through a fragmentation warhead embodying the present invention.

In FIG. 1, the fragmentation warhead has a main explosive charge 1 located within an axially extending cylindrical jacket 2 with a fragmentation layer 3 encircling and in contact with an outer surface of the jacket.

A damping layer 4 formed of a plastics material, encloses the fragmentation layer 3. The outer surface of the damping layer has axially extending recesses, each containing a deformation charge 5*a–e* in the form of explosive material strips.

The recesses in the damping layer 4 are separated by webs 6 extending inwardly from the outer surface of the layer and extending in the axial direction so that each explosive material strip 5*a–e* extends in the circumferential direction between the webs. Extending in the axial direction and centered within the webs are plate-like strips 7 formed of metal or other materials having a different shock wave impedance than the material of the webs. Due to the layered arrangement, the damping of the shock wave upon ignition of the deformation charges 5*a–e* compared to the adjacent or other deformation load charges of the warhead is achieved.

A central tube 8 is provided within the jacket 2 forming a central space 9, assuring that the main explosive charge 1 can be adequately compressed upon detonation of the deformation charges 5*a–e* whereby the jacket 2 and the fragmentation layer 3 on the side facing the target 17 (note FIG. 3) can be deformed inwardly.

At its ends extending transversely of the axis, the warhead is closed by plates 10, 11 each at one of the end faces. A firing charge for detonating the main explosive charge 1 is located at the end plate 10 and is formed of an electrical detonator 12, a transfer charge 13 and a magnification charge 14.

FIG. 1 further shows sensor 19 and the device 20 for activating the deformation charges and the main explosive charge.

Each of the deformation charges 5*a–e* has an electrical detonator 15 for igniting the deformation charges and the detonator is connected by a fuse 16 to the charges. Accordingly, each deformation charge 5*a–e* has its own firing chain, so that the deformation charges can be controlled and fired individually.

Figure 3:
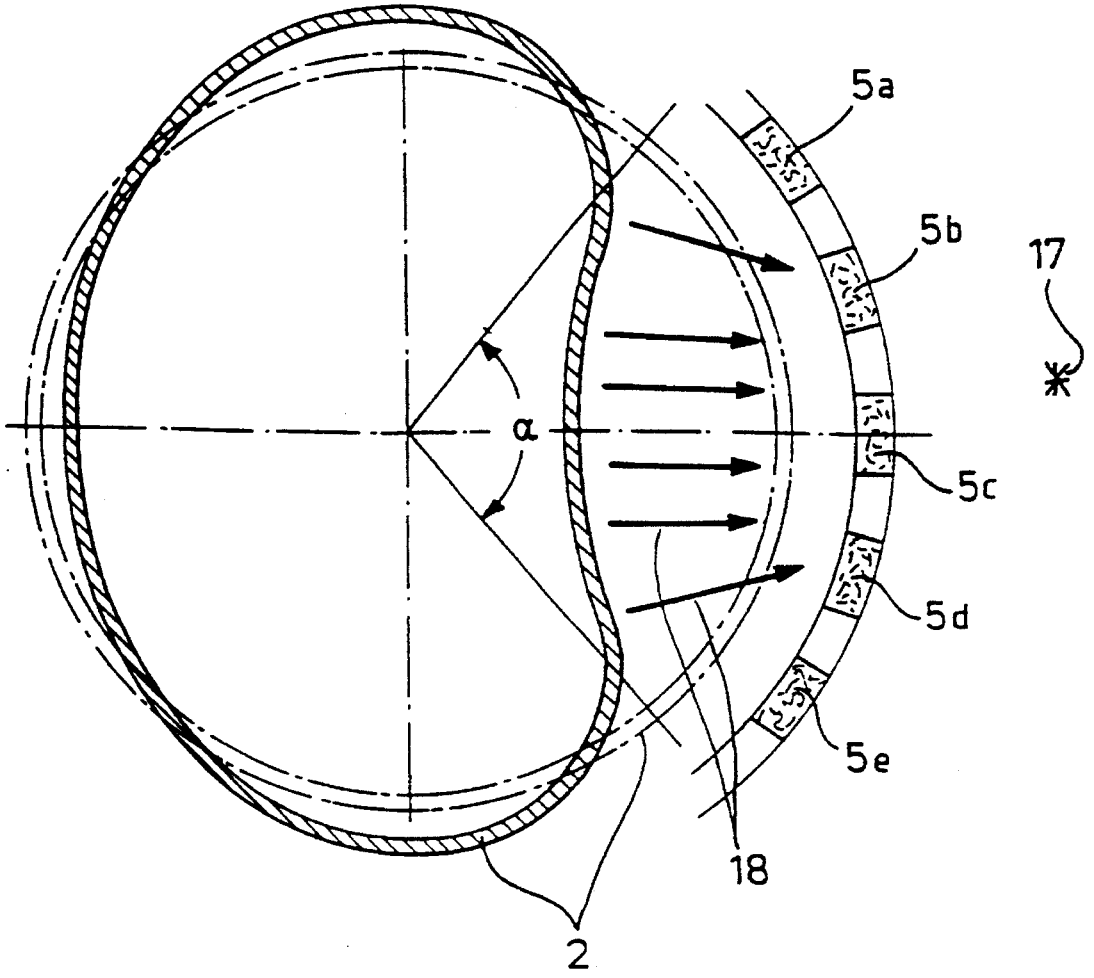
FIG. 3 is a view of the jacket taken transversely of the axial direction after it has been deformed.

When the warhead approaches a target 17, note FIG. 3, the deformation charges 5*a–e*, located on the side of the warhead facing the target 17, are ignited as shown in FIG. 3, where the cylindrical jacket 2 is shown in dotted lines in FIG. 3 in its original conformation configuration and is indented in a slightly concave manner over an angular sector with an angle alpha as displayed in solid lines. Following this deformation, the main explosive charge 1 is ignited in a time delayed manner by the detonator 12, the transfer charge 13 and the magnification charge 14 whereby the fragments from the fragmentation layer 3 travel toward the target 17 in a slightly converging manner as displayed by the arrows 18, affording a very high hit density in the region of the target 17.

A pronounced inward deformation of the jacket 2 is achieved if all of the deformation charges 5*a–e* are ignited, however, a lesser deformation of the jacket 2 is provided if every second deformation charge is fired, that is, the deformation charges 5*a*, 5*c* and 5*e*. The size of the deformed sector can be regulated by determining the spacing of the two outermost ignited deformation charges, thus as shown in FIG. 3 by the spacing of the deformation charges 5*a* and 5*e* from one another. An additional adjustment of the deformed sector of the jacket can be achieved if the deformation charges 5*a–e* are not ignited simultaneously, but rather with a small time delay, that is, if initially the deformation charge 5*c* is fired, then the deformation charges 5*b* and 5*d*, and then finally the deformation charges 5*a* and 5*e*.

Figure 2:
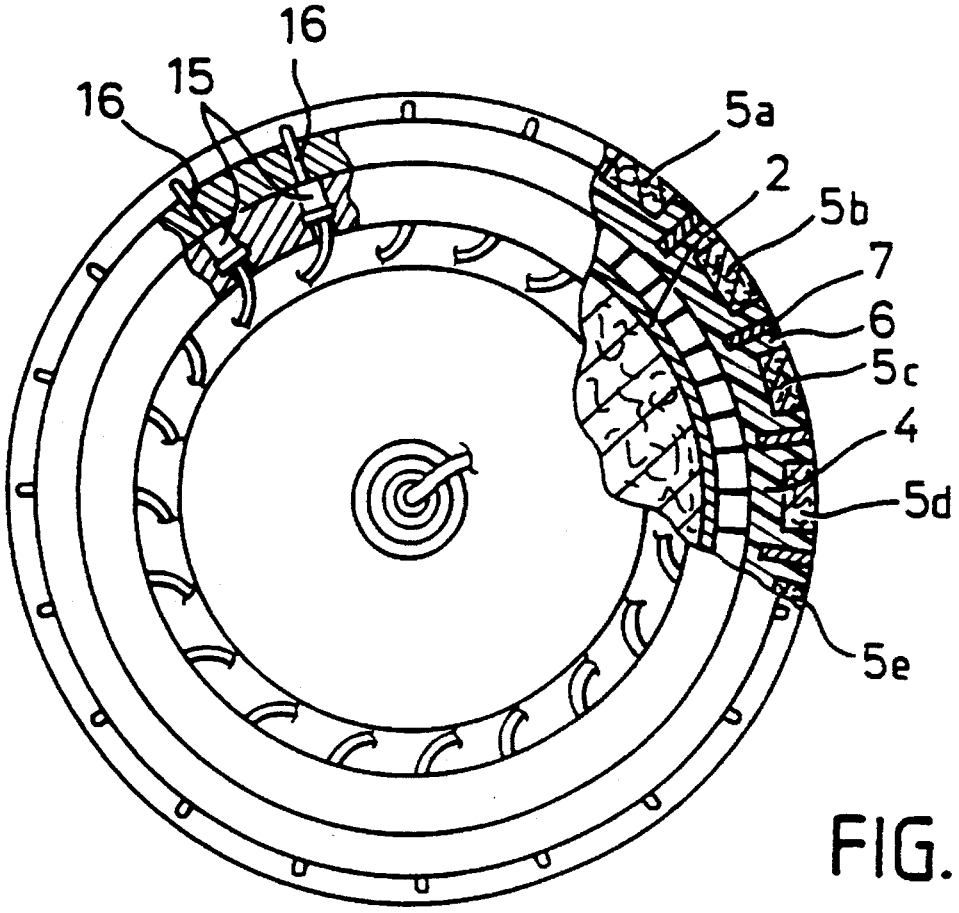
FIG. 2 is a plan view partly in section, of the warhead illustrated in FIG. 1.

Moreover, the inwardly deformed sector of the jacket 2 can be aligned with the target in a very precise manner. For instance, if twenty deformation charges are provided, as shown in FIG. 2, the angle at which the fragments fly towards the target changes by approximately 18° (360°/20), if the charges 5*b–e* are ignited instead of the deformation charges 5*a–d*.

While specific embodiments of the invention have been shown and described in detail to illustrate the application of the inventive principles, it will be understood that the invention may be embodied otherwise without departing from such principles.

I claim:

1. Fragmentation warhead, comprising:

an axially extending cylindrical jacket having an outer surface and an inner surface;

a fragmentation layer encircling and in contact with the outer surface of said jacket;

a main explosive charge located within the jacket;

a plurality of separate deformation charges located around and spaced outwardly from said fragmentation layer, said deformation charges extending in the axial direction of said jacket and arranged to inwardly deform the jacket and fragmentation layer along a side of the warhead facing a target before igniting the main explosive charge located within the jacket;

means for locating the deformation charges around and spaced outwardly from the fragmentation layer;

means for individually controlling and igniting a group of said deformation charges;

an axially extending central tube located within and spaced inwardly from said cylindrical jacket and forming therebetween an annular space, wherein said main explosive charge is located within said annular space between said central tube and cylindrical jacket;

wherein said fragmentation layer has;

an outer surface;

a damping layer extending radially outwardly from the outer surface of said fragmentation layer and forming an axially extending outer surface of said warhead; and axially and radially inwardly extending recesses located in the outer surface of said damping layer, said recesses spaced circumferentially apart and containing said deformation charges.

2. Fragmentation warhead, as set forth in claim 1, wherein said deformation charges comprise axially extending explosive material strips.

3. Fragmentation warhead, as set forth in claim 2, wherein said damping layer forms radially outwardly extending webs located between said recesses and further comprising axially extending plate-like strips located in said webs between and spaced from said recesses, said strips having a different shock wave impedance than said webs of said damping layer.

4. Fragmentation warhead, set forth in claim 3, further comprising an end plate is located at each end of said cylindrical jacket extending transversely of the axis thereof, wherein said end plates form closures for the annular space containing the main explosive charge.

5. Fragmentation warhead, set forth in 4, further comprising:

an electrical detonator;

a transfer charge; and a magnification charge, wherein said detonator, transfer charge and magnification charge are located at one of said end plates for igniting said main explosive charge.

* * * * *